US006620567B2

(12) United States Patent
Sakimura et al.

(10) Patent No.: US 6,620,567 B2
(45) Date of Patent: Sep. 16, 2003

(54) ELECTROPHOTOGRAPHIC PHOTORECEPTOR, IMAGE FORMING APPARATUS AND PROCESSING CARTRIDGE

(75) Inventors: Tomoo Sakimura, Hachioji (JP); Shinichi Hamaguchi, Hino (JP); Hirofumi Hayata, Hino (JP); Chigusa Miyake, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/058,612

(22) Filed: Jan. 28, 2002

(65) Prior Publication Data

US 2002/0142239 A1 Oct. 3, 2002

(30) Foreign Application Priority Data

Jan. 30, 2001 (JP) ..... 2001/021574

(51) Int. Cl.[7] ..... G03G 5/047
(52) U.S. Cl. ..... 430/60; 430/65
(58) Field of Search ..... 430/60, 65

(56) References Cited

U.S. PATENT DOCUMENTS 5,916,720 A * 6/1999 Springett ..... 430/63
5,972,550 A * 10/1999 Tamura et al. ..... 430/65
6,214,506 B1 * 4/2001 Kurihara et al. ..... 430/65
6,472,113 B2 * 10/2002 Hamaguchi et al. ..... 430/65

FOREIGN PATENT DOCUMENTS

| | | |
|---|---|---|
| JP | 4303846 | 10/1992 |
| JP | 8328283 | 12/1996 |
| JP | 996916 | 4/1997 |
| JP | 9258469 | 10/1997 |
| JP | 11344826 | 12/1999 |

* cited by examiner

*Primary Examiner*—John Goodrow
(74) *Attorney, Agent, or Firm*—Muserlian, Lucas and Mercanti

(57) ABSTRACT

An electrophotographic photoreceptor is disclosed. The photoreceptor has an interlayer between an electroconductive substrate and a photosensitive layer wherein the interlayer contains a particle and has a light absorbance of not more than 0.25 per micrometer of thickness at a wavelength of 1,000 nm.

An image forming apparatus and a processing cartridge employing the photoreceptor are also disclosed.

14 Claims, 1 Drawing Sheet

ELECTROPHOTOGRAPHIC PHOTORECEPTOR, IMAGE FORMING APPARATUS AND PROCESSING CARTRIDGE

FIELD OF THE INVENTION

This invention relates to an electrophotographic photoreceptor, and an image forming apparatus and a processing cartridge each using the photoreceptor.

BACKGROUND OF THE INVENTION

Recently, the main stream of technology of the electrophotographic photoreceptor is shifted to organic photoreceptor and the organic receptors using various kinds of materials are developed. Among them, the photoreceptor having a charge generation layer and a charge transportation layer piled with each other widely used, in such the photoreceptor different materials are each charged with the functions of the charge generation and the charge transportation.

The latent image formation method in the electrophotographic process can be roughly classified into an analogical image forming method in which a halogen lump is used as the light source and the reflected light from an original image is focused on the photoreceptor, and a digital image forming method in which digital electric signals corresponding to the original image are converted to light signals by a LED or laser and the light signals are focused on the photoreceptor. Recently, the digital latent image forming method is rapidly spread for a hard copy printer of personal computer or an ordinal copy machine according to the facility of such the method in the image treatment and application for a complex copy machine.

In almost original images, the area of the image portion is smaller than that of the non-image area. Consequently, a reverse developing process for developing the exposed area is mainly used for the writing by the digital method. It has been known as a peculiar problem of the image forming method using the reversal development that fog is formed by adhering the toner to the portion to be a white background of the image or formation of a black spot caused by a local defect of the photoreceptor. Such the problem is caused by a phenomenon that the potential of the photoreceptor surface which should be charged at a high potential in the reversal development of the digital image is locally dropped by leakage. Such the problem tends to be appeared accompanied with the recently improvement of the quality resolution of the image by which a defect of the latent image having a micron order size can be developed.

Technology using an interlayer is developed to solve such the problem. For example, an electrophotographic photoreceptor is known in which an interlayer comprising a resin and a titanium oxide particle dispersed in the resin is provided between an electroconductive substrate and the photosensitive layer. An interlayer containing a surface-treated titanium oxide particle is also known. Examples of such the surface-treated titanium oxide include titanium oxide surface-treated by iron oxide or tungsten oxide described in Japanese Patent Publication Open to Public Inspection, hereinafter referred to as JP O.P.I., No. 4-303846, titanium oxide treated by an amino group-containing coupling agent described in JP O.P.I. No. 9-96916, titanium oxide surface-treated by an organic silicon compound described in JP O.P.I. No. 9-258469 and titanium oxide surface-treated by a methylhydrogenpolysiloxane described in JP O.P.I. No. 8-328283. However, the formation of black spot cannot be sufficiently inhibited under a serious condition such as a high temperature and high moisture or a low temperature and low moisture even when the foregoing technology is applied. Moreover, problems such that a sufficient density cannot be obtained as a result of increase in the remained potential and the potential at the light-exposed area caused by repeating of the use are raised in such the case. JP O.P.I. No. 11-344826 proposes a photoreceptor having an interlayer using a branch-shaped titanium oxide surface-treated by a metal oxide or an organic compound. However, it is found according to the result of the examination based of the example described in the publication that the black spot preventing effect under the high temperature and high moisture condition is insufficient.

SUMMARY OF THE INVENTION

The object of the invention is to provide an electrophotographic photoreceptor forming no image defect such as the black spot. In detail, the object of the invention is to provide an electrophotographic photoreceptor having an interlayer by which formation of the image defect such as the black spot can be prevented, and an image forming apparatus using such the photoreceptor and a processing cartridge.

1. An electrophotographic photoreceptor having an interlayer provided between an electroconductive substrate and a photosensitive layer in which the interlayer contains a particle and has a light absorbance of not more than 0.25 per micrometer of thickness at a wavelength of 1,000 nm.

2. The electrophotographic photoreceptor described in 1 in which the particle is a metal oxide particle having a number average primary particle diameter of from 10 nm to 200 nm.

3. The electrophotographic photoreceptor described in the foregoing 2 in which the metal oxide particle is an N-type semiconductive particle.

4. The electrophotographic photoreceptor described in the foregoing 3 in which the N-type semiconductive particle is a titanium oxide particle.

5. The electrophotographic photoreceptor described in the foregoing 4 in which the titanium oxide particle is one subjected to plural times of surface-treatment and the last surface-treatment is carried out by a reactive organic silicon compound.

6. The electrophotographic photoreceptor described in the foregoing 5 in which the reactive organic silicon compound is methylhydrogenpolysiloxane.

7. The electrophotographic photoreceptor described in the foregoing 5 in which the reactive organic silicon compound is an organic silicon compound represented by Formula 1.

$$R—Si—(X)_3 \qquad \text{Formula 1}$$

In the formula R is an alkyl or aryl group, X is a methoxy or ethoxy group or a halogen atom.

8. The electrophotographic photoreceptor described in the foregoing 7 in which R in Formula 1 is an alkyl group having from 4 to 8 carbon atoms.

9. The electrophotographic photoreceptor described in any one of the foregoing 5 to 8 in which at least one of the plural surface-treatments is carried out by one or more compounds selected from the group consisting of alumina, silica and zirconia.

10. The electrophotographic photoreceptor described in any one of the foregoing 4 to 9 in which the titanium oxide particle is surface treated by both or one of silica and alumina and then surface treated by the reactive organic silicon compound.

11. The electrophotographic photoreceptor described in the foregoing 4 in which the titanium oxide particle is surface-treated by an organic silicon compound having a fluorine atom.

12. The electrophotographic photoreceptor described in any one of the foregoing 1 to 11 in which the interlayer contains polyamide resin.

13. An image forming apparatus for repeatedly forming images comprising an electrophotographic photoreceptor and, arranged around them, a charge providing member, a light-exposing member and a developing member in which the electrophotographic photoreceptor is the electrophotographic photoreceptor described in any one of the foregoing 1 to 12.

14. A processing cartridge to be used in an image forming apparatus for repeatedly forming images comprising an electrophotographic photoreceptor and, arranged around them, a charge providing member, a light-exposing member, a developing member, a transferring member and a cleaning member, in which the electrophotographic photoreceptor has the electrophotographic photoreceptor described in any one of the foregoing 1 to 12, and at least one of the charge providing member, the light-exposing member, the developing member, transferring member and the cleaning member is made into an unit and is constituted so as to be able to get and off to an image forming apparatus.

DETAIL DESCRIPTION OF THE INVENTION

Figure 1:
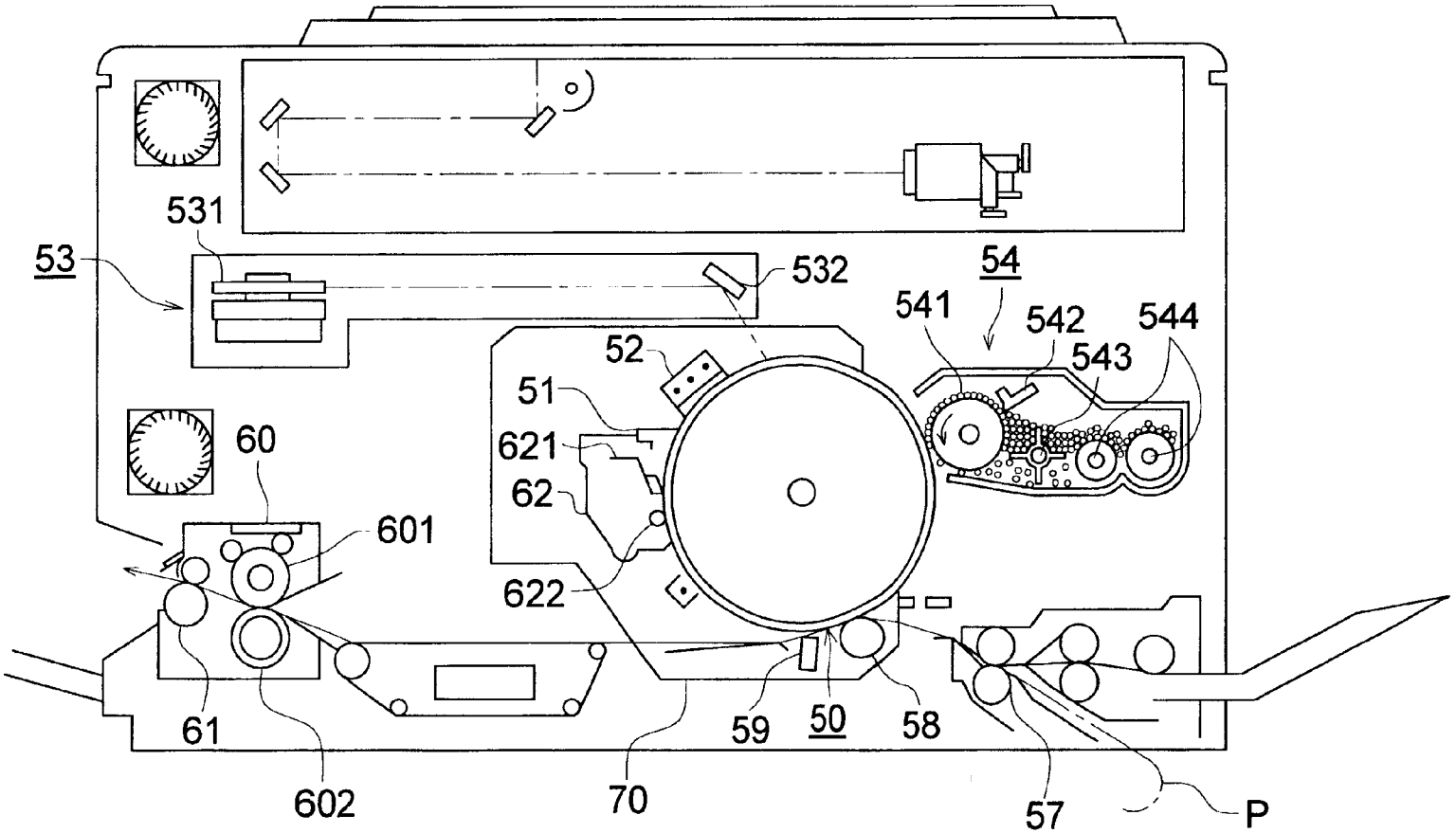
FIG. 1 shows a cross section of an image forming apparatus as an example of the image forming method.

The invention is described in detail below. The electrophotographic photoreceptor according to the invention, hereinafter referred to as the photoreceptor, has an interlayer provided between an electroconductive substrate and the interlayer contains a particle and has a light absorbance of a specified value or less per unit thickness of the layer.

It has been found by the inventors that one of the large causes of the black spot is a porous portion in the interlayer such as a coarse particle having a large primary particle diameter or a particle which is not dispersed until the primary particle or a coagulated particle formed by coagulation at the time of coating. Accordingly, the black spot inhibiting effect of the interlayer can be raised by using of a particle having a small primary diameter, finely dispersing the particles and forming an uniform layer. The measure of the uniformity of the layer is the light absorbance of the layer per unit of the thickness.

It is preferred that the particle to be contained in the interlayer has a number average primary particle diameter of from 10 nm to 200 nm. When the particle diameter is too small, a large energy is required to disperse the particles or the particles tends to be coagulated since the coagulation force of the particle is made larger. When the particle diameter is too large, the black spot inhibiting ability tends to be lowered since the interlayer is essentially made porous. Consequently, the particle having the forgoing number average primary particle diameter is preferably used.

In the system of the interlayer which contains the particles having a number average primary particle diameter of from 10 nm to 200 nm and has a light absorbance at 1,000 nm of not more than 0.25 per 1 $\mu$m of the thickness of, the wavelength of light is clearly larger than the particle diameter. Accordingly, such the system is included in the region of Rayleigh scattering. It is known that, generally in such the region, the scatter of light is proportionally decreased with 6 power of the particle diameter. Namely, when the particles are uniformly dispersed near the primary particle diameter, the scatter is made very weak and the light absorbance of the interlayer is extremely come close to zero. Contrary, when the coarse particles caused by coagulation are increased, the scattering is rapidly increased and the light absorbance is raised. Therefore, the uniformity of the layer is made higher and the black spot inhibiting ability of the interlayer is made larger accompanied with reducing the light absorbance.

The light absorbance of the layer per 1 $\mu$m of the thickness is not more than 0.25, preferably from 0.020 to 0.20. It is not essentially difficult to limit the lower limit of the primary particle diameter, but to make the light absorbance to less than 0.020 is not practical at the present time since an excessively long time is required to disperse the particles.

The light absorbance is represented by the following equation when the incident light amount $I_0$ is becomes I after passing through the interlayer.

$$\text{Light absorbance}=\log_{10}(I_0/I)$$

The number average primary particle diameter is a value of Fere direction average diameter measured by image analyze of 100 particles as the primary particles which are randomly selected from the electron microscopic photograph of the interlayer magnified 10,000 times by a transfer type electron microscope.

The light absorbance can be measured by a usual spectrophotometer.

The particle contained in the interlayer is preferably a metal oxide, more preferably an N-type semiconductive particle even though the particle may be an organic or inorganic substance without any limitation. A fine particle of titanium oxide $TiO_2$, zinc oxide $ZnO_2$ and tin oxide $SnO_2$ are suitable in concrete. Among them, titanium oxide is preferable and an N-type semiconductive particle surface-treated for giving a high dispersion suitability is more preferable. A particle of titanium oxide subjected to the surface treatment is particularly preferred. The content of the particle in the interlayer is preferably from 10 to 90%, more preferably from 25 to 75%, by volume.

The N-type semiconductive particle is a fine particle in which an electron functions as an electroconductive carrier. The N-type semiconductive particle effectively blocks a hole injected from the substrate and does not block an electron injected from the photosensitive layer when such the particle contained in an insulating binder.

The surface treatment of the N-type semiconductive particle means to cover the surface of the particle by the metal oxide, a reactive organic silicon compound or an organic metal compound. The surface treatment of the N-type semiconductive particle preferably applied in the invention is described below.

One of preferable surface treatments for the N-type semiconductive particle is a treatment in which plural times of treatment are performed and the last treatment thereof is carried out by the reactive organic silicon compound.

Another preferable surface treatment for the N-type semiconductive particle is a treatment by methylhydrogenpolysiloxane.

Another preferable surface treatment for the N-type semiconductive particle is a treatment by an organic silicon compound having a fluorine atom.

The formation of black spot can be considerably inhibited without any deterioration in the electrophotographic properties such as the remaining potential and the charging potential by providing an interlayer containing the N-type semiconductive particle subjected to the surface treatment by on of the foregoing three kinds of treatment between the electroconductive substrate and the photosensitive layer. The formation of moiré by the laser exposure can also be improved.

The size of the titanium oxide particle preferably to be used in the invention is from 10 nm to 200 nm in number average primary particle diameter. An interlayer coating liquid containing the foregoing titanium oxide particles has a high dispersion stability and the formation of the black spot can be sufficiently inhibited by the use of the interlayer formed by such the coating liquid.

The shape of titanium oxide includes a branched-shape, a needle-shape and a granule-shape. The crystal type of the titanium oxide particle having such the shapes includes an anatase-type, a rutile-type and an amorphous-type. Titanium oxide having any shape and any crystal type may be used, and a mixture of two or more kinds of titanium oxide each different from the other in the shape and the crystal type is also may be used.

In one of the surface treatments to be applied to the N-type semiconductive particle, plural times of treatments are applied and the last treatment of the plural treatments is carried out by the reactive organic silicon compound. It is preferred that at least on of the foregoing plural times of surface treatments is performed by the use of one or more kinds of compound selected from alumina $Al_2O_3$, silica $SiO_2$ and zirconia $ZrO_2$, and the surface treatment by the reactive organic silicon compound is performed at last. The above-mentioned compounds include a hydrated compound.

In another one of the surface treatments to be applied to the N-type semiconductive particle, plural times of treatments are applied and the last treatment is carried out by the use of a reactive organic titanium compound or a reactive organic zirconium compound. It is preferred that at least on of the foregoing plural times of surface treatments is carried out by the use of one or more kinds of compound selected from alumina, silica and zirconia, and the surface treatment by a reactive organic titanium compound or a reactive organic zirconium compound is performed at last.

The surface of the N-type semiconductive particle is uniformly covered by applying two or more times of the surface treatment as above-mentioned. The dispersibility of the N-type semiconductive particle in the interlayer is improved by the use of such the surface-treated N-type semiconductive particle in the interlayer and a suitable photoreceptor inhibited in the formation of image defect such as the black spot can be produced.

The N-type semiconductive particle treated by the use of alumina or silica and then treated by the reactive organic silicon compound and the N-type semiconductive particle treated by the use of alumina or silica and then treated by the reactive organic titanium compound or the reactive organic zirconium compound are particularly preferred.

It is particularly preferable that the treatment by alumina is firstly applied and then the treatment by silica is performed even though the foregoing treatments by alumina and silica may be applied simultaneously. The treating amount of silica is preferably larger than that of alumina when the treatment by alumina and that by silica are each applied.

The surface treatment of the N-type semiconductive particle by the metal oxide such as alumina, silica and zirconia may be performed by a wet method. For example, the N-type semiconductive particle surface-treated by silica or alumina can be prepared by the following procedure.

When titanium oxide particle is used as the N-type semiconductive particle, titanium oxide particles having a number average primary particle diameter of 50 nm were dispersed in water in a concentration of from 50 to 350 g to prepare an aqueous slurry, and a water-soluble silicate or a water-soluble aluminum compound is added to the slurry. Then the slurry is neutralized by the addition of an alkali or an acid to precipitate silica or alumina onto the surface of the titanium oxide particles. Thereafter, the particles are filtered, washed and dried to prepare the subjected surface-treated titanium oxide. When sodium silicate is used as the forgoing water-soluble silicate, the slurry can be neutralized by an acid such as sulfuric acid, nitric acid and hydrochloric acid. On the other hand, when aluminum sulfate is used as the forgoing water-soluble aluminum compound, the slurry can be neutralized by an alkali such as sodium hydroxide and potassium hydroxide.

The amount of the metal oxide to be used in the surface-treatment is from 0.1 to 50 parts, preferably from 1 to 10 parts, by weight to 100 parts by weight of the N-type semiconductive particle such as titanium oxide in the charging amount at the time of the surface treatment. In the above-mentioned case using alumina and silica, it is preferable that alumina and silica are each used in an amount of from 1 to 10 parts by weight per 100 parts by weight of titanium oxide particles, and that the amount of silica is larger than that of alumina.

The surface treatment by the reactive organic silicon compound to be applied next to the surface treatment by the metal oxide is preferably performed by the following wet method.

The titanium oxide treated by the metal oxide is added to a liquid which is prepared by dissolving or suspending the reactive organic silicon compound in an organic solvent or water, and the mixture is stirred for a period of from several minutes to about one hour. The titanium oxide is filtrated and dried to prepare titanium oxide particles each covered with the organic silicon compound. In some cases, the mixture is heated before the filtration. The reactive organic silicon compound may be added to a suspension prepared by dispersing the titanium oxide particles in an organic solvent or water. It is confirmed by a combination of surface analysis means such as electron spectroscopy for chemical analysis (ESCA), Auger electron spectroscopy, secondary ion mass spectroscopy and scatter reflection FI-IR that the surface of the titanium oxide particle is covered with the reactive organic silicon compound.

The amount of the reactive organic silicon compound to be used for the surface treatment is preferably from 0.1 to 50, more preferably from 1 to 10, parts by weight per 100 parts by weight of the titanium oxide surface-treated by the metal oxide. Sufficient effect of the surface treatment can be obtained by the use of such the amount of the reactive organic silicon compound. Consequently, suitable dispersibility of the titanium oxide particles in the interlayer is obtained and no deterioration of the electric property of the photoreceptor such as increasing of the remained potential or decreasing of the charged potential is occurred.

The reactive organic silicon compound is a compound capable of condensation reacting with a hydroxyl group on the surface of the titanium oxide. Preferable examples of the compound are represented by the following Formula 2.

$$(R)_n—Si—(X)_{4-n} \qquad \text{Formula 2}$$

In the above, Si is a silicon atom, R is an organic group which is directly bonded to the silicon atom by the carbon atom thereof, X is a hydrolysable group and n is an integer of from 0 to 3.

Examples of the organic group represented by R which is directly bonded to the silicon atom by the carbon atom thereof include an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl)ethyl group; a (metha)acryloyl group-containing group such as a γ-acryloxypropyl group and a γ-methacryloxypropyl group; a hydroxyl group-containing group such as a γ-hydroxy propyl group and a 2,3-dihydroxypropyloxypropyl group; a vinyl group-containing group such as a vinyl group and a propenyl group; a mercapto group-containing group such as a γ-mercaptopropyl group; an amino group-containing group such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluorooctylethyl group; and an alkyl group substituted by a nitro group or a cyano group. Examples of the hydrolysable group represented by X include an alkoxyl group such as a methoxy group and an ethoxy group; a halogen atom and an acyloxy group.

The organic silicon compounds represented by Formula 2 may be used singly or in combination.

In the compound represented by Formula 2, when n is 2 or I S S plural groups represented by R may be the same or different from each other when n is 2 or more, and groups represented by X may be the same or different from each other. When two or more kinds of the compound are used, R and X may be the same or different from each other between the different compounds.

Examples of the compound in which n is 0 are as follows: tetrachlorosilane, diethoxydichlorosilane, tetramethoxysilane, phenoxytrichlorosilane, tetraacetoxysilame, tetraethoxysilane, tetraallyoxysilane, tetrapropoxysilane, tetrakis(2-methoxyethoxy)silane, tetrabutoxysilane, tetraphenoxysilane, tetrakis(2-ethylbutoxy)silane and tetrakis(2-ethylhexyloxy)silane.

Examples of the compound in which n is 1 are as follows: trichlorosilane, methyltrichlorosilane, vinyltrichloro-silane, ethyltrichlorosilane, allyltrichlorosilane, n-propyltrichlorosilane, n-butyltrichlorosilane, chloromethylmethotrimethoxysilane, mercaptomethyltrimethoxysilane, trimethoxyvinylsilane, ethyltrimethoxysilane, 3,3,4,4,5,5,6,6,6-nonafluorohexyltrichlorosilane, phenyltrichlorosilane, 3,3,3-trifluoropropyltrimethoxysilane, 3-chloropropyltrimethoxysilane, triethoxysilane, 3-mercaptopropyltrimethoxysilane, 3-aminopropyltrimethoxysilane, 2-aminoethylaminometyltrimethoxysilane, benzyltrichlorosilane, methyltriacetoxysilane, chloromethyltriethoxysilane, ethyltriacetoxysilane, phenyltrimethoxysilane, 3-allylthiopropyltrimethoxysilane, 3-glycidoxypropyl-trimethoxysilane, 3-bromopropyltriethoxysilane, 3-allyaminopropyltrimethoxysilane, propyltriethoxysilane, hexyltritrimethoxysilane, 3-aminopropyltriethoxysilane, 3-methacryloxypropyltrimethoxysilane, bis (ethylmethylketoxime)methoxymethylsilane, octyltriethoxysilane and dodecyltriethoxysilane.

Examples of the compound in which n is 2 are as follows: dimethyldichlorosilane, dimethoxymethylsilane, dimethoxydimethylsilane, methyl-3,3,3-trifluoropropyldichlorosilane, diethoxysilane, diethoxymethylsilane, dimethoxymethyl-3,3,3-trifluoropropylsilane, chloromethyldiethoxysilane, diethoxydimethylsilane, dimethoxy-3-mercaptopropylmethylsilane, 3,3,4,4,5,5,6,6,6-nonafluorohexylmethyldichlorosilane, diacetoxymethylvinylsilane, diethoxymethylvinylsilane, 3-methacryloxypropylmethyldichlorosoilane, 3-(2-aminoethylaminopropyl)dimethoxymethylsilane, t-butylphenyldichlorosilane, 3-methacryloxypropyldimethoxymethylsilane, 3-(2-acetoxyethylthiopropyl)dimethoxymethylsilane, dimethoxymethyl-2-piperidinoethylsilane, dibutoxydimethylsilane, 3-dimethylaminopropyldiethoxymethylsilane, diethoxymethylphenylsilane, diethoxy-3-glycidoxypropylmethylsilane, 3-(3-acetoxyporopylthio) propyldimethoxymethylsilane, dimethoxymethyl-3-piperidinopropylsilane and diethoxymethyloctadecylsilane.

Examples of the compound in which n is 3 are as follows: trimethylchlorosilane, methoxytrimethylsilane, ethoxytrimethylsilane, methoxydimethyl-3,3,3-trifluoropropylsilane, 3-chloropropylmethoxydimethylsilane and methoxy-3-mercaptopropylmethylmethylsilane.

Preferable examples of the organic silicon compound represented by Formula 2 are represented by the following Formula 1.

$$R—Si—(X)_3 \qquad \text{Formula 1}$$

In the above, R is an alkyl group or an aryl group; and X is a methoxy group, an ethoxy group or a halogen atom.

R is preferably an alkyl group having from 4 to 8 carbon atoms. Examples of the preferable compound include trimethoxy-n-butylsilane, trimethoxy-i-butylsilane, trimethoxyhexylsilane and trimethoxyoctylsilane.

A hydrogenpolysiloxane compound is preferably used as the reactive organic silicon compound to be used in the last surface treatment. The hydrogenpolysiloxane having a molecular weight of from 1,000 to 20,000 is easily available and shows a suitable black spot inhibiting ability. Particularly, good effect can be obtained when methylhydrogenpolysiloxane is used for the last surface treatment.

Another surface treatment for the titanium oxide is a treatment by an organic silicon compound having a fluorine atom. The treatment using the organic silicon compound having a fluorine atom is preferably applied by the following wet method.

The organic silicon compound having a fluorine atom is dissolved or suspended in an organic solvent or water and untreated titanium oxide particles are added therein. The liquid is mixed by stirring for a period of from several minutes to about 1 hour. Then the particles are filtered and dried. Thus the surface of each of the titanium oxide particles is covered by the organic silicon compound having a fluorine atom. In some cases, the mixture is heated before the filtration. The organic silicon compound having a fluorine atom may be added to the suspension comprising the organic solvent or water and the titanium oxide particles dispersed therein.

It is confirmed by a combination of surface analysis means such as electron spectroscopy for chemical analysis (ESCA), Auger electron spectroscopy, secondary ion mass spectroscopy and scatter reflection FI-IR that the surface of the titanium oxide particle is covered with the organic silicon compound having a fluorine atom.

Examples of the organic silicon compound having a fluorine atom include 3,3,4,4,5,5,6,6,6-nonafluorohexyltrichlorosilane, 3,3,3-trifluoropropyltrimethoxysilane, methyl-3,3,3-trifluoropropyldichlorosilane, dimethoxymethyl-3,3,3-trifluoropropylsilane and 3,3,4,4,5,5,6,6,6-nonafluorohexylmethyldichlorosilane.

The last surface treatment to be applied to the N-type semiconductive particle may be carried out by the use of a reactive organic titanium compound or a reactive organic zirconium compound. The treatment is performed in a manner similar to that using the reactive organic silicon compound.

It is exactly confirmed by a combination of surface analysis means such as electron spectroscopy for chemical analysis (ESCA), Auger electron spectroscopy, secondary ion mass spectroscopy and scatter reflection FI-IR that the surface of the titanium oxide particle is covered with the reactive organic titanium compound or the reactive organic zirconium compound.

Concrete examples of the reactive organic titanium compound to be used for surface treatment of the N-type semiconductive particle include a metal alkoxide compound such as titanium tetrapropoxide and titanium tetrabutoxide; and a metal chelate compound such as diisopropoxytitanium bis(acetylacetate), diisopropoxytitanium bis(ethylacetoacetate), diisopropoxytitanium bis(lactate), dibutoxytitanium bis(octyleneglycolate) and diisopropxytitanium bis(triethanolaluminate). Examples of the reactive organic zirconium compound include a metal alkoxide compound and a metal chelate compound such as zirconium tetrabutoxide and butoxyzirconium tri(acetylacetate).

The interlayer containing the N-type semiconductive particle such as the titanium oxide particle treated on its surface, hereinafter referred to as the surface-treated N-type semiconductive particle and the titanium oxide particle treated on its surface is referred to as the surface-treated titanium oxide, is described below.

The interlayer is formed by coating a liquid comprising a solvent in which the surface-treated N-type semiconductive particles such as the surface-treated titanium oxide particles are dispersed together with a binder resin, on an electroconductive substrate.

The interlayer is provided between the electroconductive substrate and the photosensitive layer and has functions of suitably adhering with the electroconductive substrate and the photosensitive layer, suitably transfer an electron injected from the photosensitive layer to the electroconductive substrate and preventing the positive hole injection from the substrate as a barrier.

The resin binder usable in the interlayer includes a polyamide resin, a vinyl chloride resin, a vinyl acetate resin, a poly(vinyl acetal) resin, a poly(vinyl butyral) resin, a polyvinyl alcohol, a thermal hardenable resin such as a melamine resin, an epoxy resin and an alkyd resin, and a copolymer resin composed of two or more repeating units of the fore going resins. Among them, the polyamide resin is preferable and an alcohol-soluble polyamide such as an amide copolymer and a methoxymethylolized amide polymer is particularly preferable.

The amount of the surface-treated N-type semiconductive particle according to the invention to be dispersed in the binder is from 10 to 10,000 parts, preferably from 50 to 1,000 parts, by weight per 100 parts by weight of the binder resin in the case of the surface-treated titanium oxide. When the surface-treated titanium oxide is used in the foregoing amount, the dispersed status of the titanium oxide can be suitably maintained and a suitable interlayer without the formation of black spot can be formed.

The thickness of the interlayer is preferably from 0.5 to 15 $\mu$m for forming the interlayer having a suitable electrophotographic property without the formation of black spot.

An interlayer coating composition for forming the interlayer comprises the surface treated N-type semiconductive particle such as the surface-treated titanium oxide, the binder resin and a dispersing solvent. A solvent to be used for preparation of the photosensitive layer can be optionally used as the dispersing solvent.

Examples of the solvent or the dispersing medium to be used for preparing the interlayer, the photosensitive layer and another layer include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,1,2-trichloroethane, 1,1,1-trichloroethane, trichloroethylene, tetrachloroethane, tetrahydrfurane, dioxorane, dioxane, methanol, ethanol, butanol, iso-propanol, ethyl acetate, butyl acetate, dimethylsulfoxide and methyl cellosolve.

The solvent for the interlayer coating composition is not limited thereto. Among them, methanol, ethanol, 1-propanol and iso-propanol are preferably used. The solvents may be used singly or in combination.

A mixture of methanol having a high resin dissolving ability and a straight-chain alcohol is preferably used for the interlayer coating solvent to prevent the formation of drying unevenness. The preferable mixing ratio of the straight-chain alcohol to 1 of methanol by volume is from 0.05 to 0.6. The evaporation speed of the solvent is suitably maintained by the use of such the mixed solvent so as to prevent occurrence of the image defect caused by the drying unevenness.

Any dispersing means such as a sand mill, a ball mill and an ultrasonic disperser may be used for dispersing the surface-treated titanium oxide to prepare the interlayer coating composition.

A coating method such as an immersion coating, a spray coating and coating by a coating amount controlling circular coating means may be used for preparing the photoreceptor including the interlayer. The spray coating and the coating by the coating amount controlling circular coating means such as ring shaped slide hopper coating apparatus are preferably used so as to inhibit dissolution of the under layer as small as possible and to attain uniform coating. The spray coating method is described in JP O.P.I. Nos. 3-90250 and 3-269238 and the coating amount controlling circular coating means is described in JP O.P.I. No. 58-189061.

The photoreceptor preferably to be used in the invention is described below.

Electroconductive Substrate

A cylindrical electroconductive substrate is preferably used to make compact the image forming apparatus even though a cylindrical and sheet-shaped substrate may either be used.

Images can be endlessly formed by the cylindrical electroconductive substrate. The electroconductive substrate having a straightness of not more than 0.1 mm and a swing width of not more than 0.1 mm is preferred.

A drum of metal such as aluminum or nickel, a plastic drum on the surface of which aluminum, tin oxide or indium oxide is provided by evaporation, and a plastic and paper drum each coated with an electroconductive substance may be used as the material. The specific electric resistively of the electroconductive substrate is preferably not more than $10^3$ Ωcm.

The preferable photosensitive layer to be used in the electrographic photoreceptor according to the invention is described below.

Photosensitive Layer

It is preferable that the photosensitive layer having a charge generation layer CGL and a charge transfer layer CTL separated from each other even though a single structure photosensitive layer having both of the charge generation function and the charge transfer function may be used. The increasing of the remaining potential accompanied with repetition of the use can be inhibited and another electrophotographic property can be suitably controlled by the separation the functions of the photosensitive layer into the charge generation and the charge transfer. In the photoreceptor to be negatively charged, it is preferable that the CGL is provided on a subbing layer and the CTL is further provided on the CGL. In the photoreceptor to be positively charged, the order of the CGL and CTL in the negatively charged photoreceptor is revered. The foregoing photoreceptor to be negatively charged having the function separated structure is most preferable.

The photosensitive layer of the function separated negatively charged photoreceptor is described below.

Charge Generation Layer

Charge generation layer: the charge generation layer contains one or more kinds of charge generation material CGM. Another material such as a binder resin and additive may be contains according to necessity.

Examples of usable CGM include a phthalocyanine pigment, an azo pigment, a perylene pigment and an azulenium pigment. Among them, the CGM having a steric and potential structure capable of taking a stable intermolecular aggregated structure can strongly inhibit the increasing of the remaining potential accompanied with the repetition of use. Concrete examples of such the CGM include a phthalocyanine pigment and a perylene pigment each having a specific crystal structure. For example, a titanylphthalocyanine having the maximum peak of Bragg angle 2θ of Cu—Kα ray at 27.2° and a benzimidazoleperylene having the maximum peak of Bragg angle 2θ of Cu—Kα ray at 12.4° as the CGM are almost not deteriorated by the repetition of use and the increasing of the remaining potential is small.

A binder can be used in the charge generation layer as the dispersion medium of the CGM. Examples of the most preferable resin include a formal resin, a silicone resin, a silicon-modified butyral resin and a phenoxy resin. The ratio of the binder resin to the charge generation material is from 20 to 600 parts by weight to 100 parts by weight of the binder resin. By the use of such the resin, the increasing of the remaining potential accompanied with the repetition of use can be minimized. The thickness of the charge generation layer is preferably from 0.01 μm to 2 μm.

Charge Transfer Layer

Charge transfer layer: the charge transfer layer contains a charge transfer material CTM and a layer-formable binder resin in which the CTM is dispersed. An additive such as an antioxidant may be further contained according to necessity.

For example, a triphenylamine derivative, a hydrazone compound, a styryl compound, a benzyl compound and a butadiene compound may be used as the charge transfer material CTM. These charge transfer material are usually dissolved in a suitable binder resin to form a layer. Among them, the charge transfer materials capable of minimizing the increasing of the remaining potential accompanied with repetition of use is one having a high electron mobility of not less than $10^{-5}$ $cm^2/V\cdot sec$, and the difference of the ionization potential of such the CTM and that of the CGM to be used in combination with the CTM is preferably not more than 0.5 (eV), more preferably not more than 0.25 (eV).

The ionization potential of the CGM and CTM is measured by a surface analyzer AC-1, manufactured by Riken Keiki Co., Ltd.

Examples of the resin to be used for charge transfer layer CTL include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained the foregoing resins, and a high molecular weight organic semiconductive material such as poly(N-vinylcarbazole) other than the foregoing insulating resins.

The polycarbonate resin is most preferable as the binder for CTL. The polycarbonate resin is most preferable since the resin simultaneously improves the anti-abrasion ability, the dispersing ability of the CTM and the electrophotographic property of the photoreceptor. The ratio of the binder resin to the charge transfer material is preferably from 10 to 200 parts by weight to 100 parts by weight of the binder resin, and the thickness of the charge transfer layer is preferably from 10 to 40 μm.

Although the most preferable layer constitution of the photosensitive layer according to the invention is described in the above, another layer constitution may be applied.

FIG. 1 shows a cross section of an image forming apparatus as an example of the image forming method. In FIG. 1, 50 is a photoreceptor drum as an image carrier which is a drum coated with an organic photosensitive layer and further coated thereon with the resin layer according to the invention. The drum is grounded and driven so as to be rotated anticlockwise. 52 is a scorontron charging device which uniformly gives charge onto the surface of the photoreceptor drum 50 by corona discharge. In advance of the uniformly charging by the charging device (charging means) 52, the charge remained on the surface of the photoreceptor may be removed by light exposure by the means for exposing before charging 51 using a light source such as a light emission diode to remove the histolysis of the last image formation of the photoreceptor.

After the uniform charging, the photoreceptor is imagewise exposed to light by an image exposing device (exposing means) 53 according to the image information. The image exposing device 53 has a laser diode as the light source which is not shown in the drawing. The photoreceptor is scanned by a light beam turned through a rotating polygon mirror 531, an fθ lens and a reflecting mirror 532 so as to form a static latent image.

Then the static latent image is developed by a developing device (developing means) 54. The developing device 54 storing a developer comprised of a toner and a carrier is arrange around the photoreceptor 50, and the development is performed by a developing sleeve 541 which has a magnet therein and is rotated while carrying the developer. The interior of the developing device is constituted by a developer stirring member 544, a developer conveying member 543 and a conveying amount controlling member 542, and the developer is stirred, conveyed and supplied to the developing sleeve. The supplying amount of the developer is controlled by the conveying amount controlling member 542. The conveyed amount of the developer is usually within the range of from 20 to 200 $mg/cm^2$ even though the amount is varied depending on the line speed of the organic electrophotographic photoreceptor and the specific gravity of the developer.

The developer comprises, for example, the carrier comprising of a ferrite core coated with a insulating resin, and a toner comprised of a colored particle comprising a styrene-acryl resin as a principal raw material, a colorant such as carbon black, a charge controlling agent and a low molecular weight polyolefin, and an external additive such as silica and titanium oxide. The developer is conveyed to the developing zone to occur the development while the thickness of the layer formed on the developing sleeve 541 is regulated to from 100 to 600 μm by the conveying amount controlling member. At the development a direct current bias, an alternative bias according to necessity, is usually applied between the photoreceptor drum 50 and the developing sleeve. The development is performed under a condition that the developer is touched or non-touched to the photoreceptor.

The recording paper P is supplied into the transferring zone by the rotation of a paper supplying roller 57 at when the timing for transfer is adjusted after the image formation.

In the transferring zone, a transferring roller (transferring device) 58 as a transferring means is pressed to the surface of the photoreceptor drum 50 synchronized with the timing of the transfer so as to put the supplied paper P between the drum and the roller to occur the transfer.

Then the electric charge on the recording paper P is removed by a separating brush (separating device) 59 which is pressed to the photoreceptor simultaneously with the transferring roller. The recording paper P is separated from the surroundings of the photoreceptor drum 50 and conveyed to a fixing device 60. The toner image is melted and adhered onto the recording paper by heating and pressing by a heating roller 601 and a pressure roller 602 and the recording paper is output from the apparatus. The transferring roller 59 and the separating brush 59 is released from the surface of the surface of the photoreceptor drum after passing of the recording paper P to prepare the next image formation.

After separation of the recording paper P, the toner remaining of the photoreceptor drum 50 is removed by a blade 612 of a cleaning device (cleaning means) 62 pressed to the drum surface and the drum surface is cleaned. The photoreceptor is subjected to charge removing by the exposing device before charging 51 and the charging by the charging device 52 to progress into the next image forming process.

70 is a processing cartridge capable of being get into and off from the image forming apparatus in which the charging device, transferring device, the separating device and the cleaning device are arranged.

The electrophotographic photoreceptor is suitable for an electrophotographic apparatus such as an electrophotographic copy machine, a laser printer, a LED printer, and further widely can be utilized to various apparatus for displaying, recording, shortrun printing, and plate making and facsimile.

EXAMPLES

The invention is described in detail according to examples. In the followings, the term of "part" means "part by weight".

The dispersion liquids for inventive and comparative interlayer were each prepared as follows.

Preparation of Interlayer Dispersion Liquid 1

Into a mixed solvent composed of 6.5 parts of methanol and 3.5 parts of 1-propanol, 1 part of polyamide resin CM-8000, manufactured by Toray Co., Ltd., was added and dissolved. To the solution, 3.5 part of titanium oxide (SMT 500 SAS, manufacture by Teika Co., Ltd., surface-treated by a silica treatment, an alumina treatment and a methylhydrogenpolysiloxane treatment and having an average diameter of 58 nm) was added and dispersed by a batch method to prepare Interlayer dispersion liquid 1. The dispersion was performed by a sand mill according to the following specification.

Sand mill: A chromium plated sand mill manufacture by Ashizawa Seisakysyo Co., Ltd.

Beads: Highbea D-24

Dispersing condition: A packing ratio of 60%, a rotating speed of 700 rpm, an effective dispersing time per liter of 10 hours and a cooling temperature of 15±5° C.

Preparation of Interlayer Dispersion Liquid 2

Interlayer dispersion liquid 2 was prepared in the same manner as in preparation of Interlayer dispersion liquid 1 except that the surface-treatment of the titanium oxide is changed to a silica treatment, an aluminum treatment and a hexyltrimethoxysilane treatment.

Preparation of Interlayer Dispersion Liquid 3

Interlayer dispersion liquid 3 was prepared in the same manner as in preparation of Interlayer dispersion liquid 1 except that a stirring homogenizer Cleamix CML-0.8S manufactured by M.Tech Co., Ltd., with rotating speed of 1,000 rpm and effective stirring time of 1 hour, was used as the dispersing means.

Preparation of Interlayer Dispersion Liquid 4

Interlayer dispersion liquid 4 was prepared in the same manner as in preparation of Interlayer dispersion liquid 1 except that an ultrasonic homogenizer US-600 manufactured by Nihon Seiki Seisakusyo Co., Ltd., with a rating output of 600 W and effective stirring time of 10 hours, was used as the dispersing means.

Preparation of Interlayer Dispersion Liquid 5

Interlayer dispersion liquid 5 was prepared in the same manner as in preparation of Interlayer dispersion liquid 2 except that a stirring homogenizer Cleamix CML-0.8S manufactured by M.Tech Co., Ltd., with rotating speed of 1,000 rpm and effective stirring time of 1 hour, was used as the dispersing means.

Preparation of Interlayer Dispersion Liquid 6

Interlayer dispersion liquid 6 was prepared in the same manner as in preparation of Interlayer dispersion liquid 2 except that an ultrasonic homogenizer US-600 manufactured by Nihon Seiki Seisakusyo Co., Ltd., with a rating output of 600 W and effective stirring time of 10 hours, was used as the dispersing means.

EXAMPLE 1

Interlayer dispersion liquid was diluted by the same solvent and filtered after standing for one night through a Ridgemesh filter manufactured by Nihon Poul Co., Ltd., with a nominal filtering precision of 5 μm and a pressure of 0.5 kgf/cm$^2$. Thus obtained filtrate was coated by an immersing method on a cylindrical aluminum substrate to form an interlayer having a dry thickness of 2 μm. A liquid in which 2 parts of titanylphthalocyanine having the maximum diffraction peak at a Bragg angle 2θ±0.2° of 27.2° of X-ray diffraction spectrum of Cu—Kα ray, 1 part of butyral resin, 70 parts of t-butyl acetate and 30 parts of 4-methoxy-4-methyl-2-pentanone were dispersed by a sand mill, was coated on the interlayer by a immersing method so as to form a charge generation layer having a thickness of 0.3 μm. Thereafter, a liquid composed of 7.5 parts of ethylene chloride and, dissolved therein, a 0.75 parts of charge transfer material, compound A, and 1 part of polycarbonate resin Eupiron Z300, manufactured by Mitsubishi Gas Kagaku Co., Ltd., was coated by a immersion method on the charge generation layer so as to form a charge transfer layer having a dry thickness of 24 μm, and dried at 100° C. for 70 minutes to prepare Photoreceptor 1.

Compound A

EXAMPLE 2

Photoreceptor 2 was prepared in the same manner as in Photoreceptor 1 except that Interlayer dispersion 2 was used in place of Interlayer dispersion 1.

Comparative Examples 1 to 4

Photoreceptors 3 through 6 were each prepared in the same manner as in Photoreceptor 1 except that Interlayer dispersions 3 through 6 were respectively used in place of Interlayer dispersion 1.

Evaluation

Each of the photoreceptors was installed in a digital copying machine Konica 7823 modified and the grid potential of the charging device and the developing bias potential of reverse development were each set at 1,000 V and 800 V, respectively.

Ten thousands sheets of A4 size copy were made by the copying machine under a high temperature and high moisture condition at 30° C. and 80% RH. A solid white image was copied at the start and every $2{,}000^{th}$ copy and the presence of black spot was counted on each of the copy. Formation status of the black spot was shown in Table 1 together with the light absorbance per 1 μm of the layer thickness.

Formation of the black spot was evaluated according to the number of black spot having a longer axis diameter of not less than 0.4 mm formed on the A4 size copy. The longer axis diameter of the black spot can be measured a microscope attached with a video printer. The evaluation norm of the black spot was as follows.

Rank of black spot formation through 10,000 sheets of copying

A: Frequency of the black spot having a longer axis diameter of not less than 0.4 mm: 3 or less/A4 in all the copies.

B: Frequency of the black spot having a longer axis diameter of not less than 0.4 mm: One or more copies each having the black spot of from 4 to 19 per A4 size sheet was formed.

C: Frequency of the black spot having a longer axis diameter of not less than 0.4 mm: One or more copies each having the black spot of 20 or more per A4 size sheet was formed.

Measurement method of light absorbance per 1 μm of the thickness of the interlayer The interlayer dispersion was coated by a wire bar on a transparent polyethylene terephthalate) sheet and dried for 5 minutes at a room temperature. The thickness of the dried layer and the light absorbance were each measure by Dektak 3030 manufactured by Sloan Technology Co., Ltd., and U-3500 manufactured by Hitach Seisakusyo Co., Ltd.

TABLE 1

| Photoreceptor | Light absorbance per 1 μm of interlayer thickness | Black spot | Remarks |
|---|---|---|---|
| Photoreceptor 1 | 0.08 | A | Example 1 |
| Photoreceptor 2 | 0.13 | A | Example 2 |
| Photoreceptor 3 | 0.57 | C | Comparative example 1 |
| Photoreceptor 4 | 0.35 | B | Comparative example 2 |
| Photoreceptor 5 | 0.64 | C | Comparative example 3 |
| Photoreceptor 6 | 0.39 | B | Comparative example 4 |

As is shown in Table 1, there is an interrelation between the light absorbance per 1 μm of interlayer thickness and the formation of the black spot by the reverse development, and the black spot formation is considerably improved in Photoreceptors 1 and 2 each having a light absorbance of 0.08 and 0.13, respectively. Contrary in Photoreceptors 3 through 6 each having the light absorbance of not less than 0.35, number of the black spots formed by these photoreceptors is larger than that formed by the Photoreceptors 1 and 2.

The photoreceptors 1 and 2 according to the invention maintain the suitable charging property and the photosensitivity, and the electrophotographic property is also satisfactory after the finish of 10,000 sheets copying.

It is cleared by the examples that the electrophotographic photoreptor considerably improved in the formation of the image defect such as the black spot under the condition high temperature and high moisture which is thought the most serious condition and having the satisfactory electrophotographic property can be obtained, and the image forming apparatus and the processing cartridge using the photoreceptor can be provided by the present invention.

What is claimed is:

1. An electrophotographic photoreceptor having an interlayer provided between an electroconductive substrate and a photosensitive layer wherein the interlayer contains a particle and has a light absorbance of not more than 0.25 per micrometer of thickness at a wavelength of 1,000 nm.

2. The electrophotographic photoreceptor of claim 1 wherein the particle is a metal oxide particle having a number average primary particle diameter of from 10 nm to 200 nm.

3. The electrophotographic photoreceptor of claim 2 wherein the metal oxide particle is an N-type semiconductive particle.

4. The electrophotographic photoreceptor of claim 3 wherein the N-type semiconductive particle is a titanium oxide particle.

5. The electrophotographic photoreceptor of claim 4 wherein the titanium oxide particle is one subjected to plural times of surface-treatment and the last surface-treatment is carried out by a reactive organic silicon compound.

6. The electrophotographic photoreceptor of claim 5 wherein the reactive organic silicon compound is methylhydrogen polysiloxane.

7. The electrophotographic photoreceptor of claim 5 wherein the reactive organic silicon compound is an organic silicon compound represented by Formula of $$R—Si—(X)_3,$$

wherein R is an alkyl or aryl group, X is a methoxy or ethoxy group or a halogen atom.

8. The electrophotographic photoreceptor of claim 7 wherein R in Formula 1 is an alkyl group having from 4 to 8 carbon atoms.

9. The electrophotographic photoreceptor of claim 5 wherein at least one of the plural surface-treatments is carried out by one or more compounds selected from the group consisting of alumina, silica and zirconia.

10. The electrophotographic photoreceptor of claim 4 wherein the titanium oxide particle is surface treated by both or one of silica and alumina and then surface treated by the reactive organic silicon compound.

11. The electrophotographic photoreceptor of claim 4 wherein the titanium oxide particle is surface-treated by an organic silicon compound having a fluorine atom.

12. The electrophotographic photoreceptor of claim 1 wherein the interlayer contains polyamide resin.

13. An image forming apparatus for repeatedly forming images comprising an electrophotographic photoreceptor and, arranged around the electrophotographic photoreceptor, a charge providing member, a light-exposing member and a developing member, wherein the electrophotographic photoreceptor is the electrophotographic photoreceptor of claim 1.

14. A processing cartridge for an image forming apparatus for repeatedly forming images comprising an electrophotographic photreceptor and, arranged around the electrophotographic photoreceptor, a charge providing member, a light-exposing member, a developing member, a transferring member and a cleaning member, wherein the electrophotographic photoreceptor has the electrophotographic photoreceptor of claim 1, and at least one of the charge providing member, the light-exposing member, the developing member, transferring member and the cleaning member is made into an unit and is constituted so as to be able to get and off to an image forming apparatus.

* * * * *

Disclaimer

6,620,567 — Tomoo Sakimura, Hazchioji (JP); Shinichi Hamaguchi, Hino (JP); Hirofumi Hayata, Hino (JP); Chigusa Miyake, Hachioji (JP). ELECTROPHOTOGRAPHIC PHOTORECEPTOR, IMAGE FORMING APPARATUS AND PROCESSING CARTRIDGE. Patent dated Sept. 16, 2003. Disclaimer filed Nov. 12, 2004, by the assignee, Konica Corporation.

The term of this patent, subsequent to the term of patent number, 6,472,113, has been disclaimed.

*(Official Gazette, October 11, 2005)*